US007558498B2

(12) United States Patent
Fujisawa

(10) Patent No.: US 7,558,498 B2
(45) Date of Patent: Jul. 7, 2009

(54) FIXING UNIT FOR AN IMAGE FORMING APPARATUS CONTROLLING PLURAL COILS IN ROTATING HEATING BODIES

(75) Inventor: Kazutoshi Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 280 days.

(21) Appl. No.: 11/241,257

(22) Filed: Sep. 30, 2005

(65) Prior Publication Data

US 2006/0067721 A1 Mar. 30, 2006

(30) Foreign Application Priority Data

Sep. 30, 2004 (JP) ..... 2004-288393

(51) Int. Cl.
*G03G 15/20* (2006.01)

(52) U.S. Cl. ..... 399/69; 399/70

(58) Field of Classification Search ..... 399/69, 399/70

See application file for complete search history.

(56) References Cited

U.S. PATENT DOCUMENTS

| | | | | |
|---|---|---|---|---|
| 5,666,627 | A * | 9/1997 | Yamaguchi | 399/330 |
| 6,516,165 | B2 * | 2/2003 | Makihira et al. | 399/69 |
| 2003/0068169 | A1 * | 4/2003 | Suzuki | 399/69 |
| 2003/0215255 | A1 | 11/2003 | Kinouchi et al. | |
| 2003/0235422 | A1 * | 12/2003 | Oyaide | 399/69 |
| 2004/0247334 | A1 * | 12/2004 | Kishi et al. | 399/69 |
| 2006/0051120 | A1 * | 3/2006 | Kishi et al. | 399/69 |

FOREIGN PATENT DOCUMENTS

| | | | |
|---|---|---|---|
| EP | 0 883 246 | | 12/1998 |
| EP | 1 178 369 | | 2/2002 |
| JP | 60022164 | A * | 2/1985 |
| JP | 06-130855 | | 5/1994 |
| JP | 08-211769 | | 8/1996 |
| JP | 09297493 | A * | 11/1997 |
| JP | 2000-194237 | | 7/2000 |
| JP | 2001-222184 | | 8/2001 |
| JP | 2003-241563 | | 8/2003 |
| JP | 2003-271003 | | 9/2003 |
| JP | 2004-045687 | | 2/2004 |
| JP | 2004-262976 | | 9/2004 |

* cited by examiner

*Primary Examiner*—Quana M Grainger
(74) *Attorney, Agent, or Firm*—Hogan & Hartson LLP

(57) ABSTRACT

A fixing unit for an image forming apparatus passes a recording medium with a unfixed toner image through between a pair of rotating bodies to fix the unfixed image to the recording medium. The fixing unit comprises a first heater for heating up one of the rotating bodies, a second heater for heating up the other of the rotating body, and a switching means for changing over a first state that the first heater and the second heater are serially connected to a power source and a second state that the first heater is connected to the power source, with the second heater being disconnected from the power source, wherein the relation: $Q_{11}/Q_{21}>1/8$ is satisfied, where $Q_{11}$ denotes a heating value of the first heater in the first state per unit of time and $Q_{21}$ denotes a heating value of the first heater in the second state per unit of time.

9 Claims, 7 Drawing Sheets

FIXING UNIT FOR AN IMAGE FORMING APPARATUS CONTROLLING PLURAL COILS IN ROTATING HEATING BODIES

CROSS-REFERENCE

The entire disclosure of Japanese Patent Application No. 2004-288393 filed on Sep. 30, 2004 is expressly incorporated by reference herein.

BACKGROUND OF THE INVENTION

1. Field of the Invention

The present invention is directed to a fixing unit and an image forming apparatus equipped with the fixing unit.

2. Description of the Prior Art

In general, an image forming apparatus such as a printer, a copying machine, a fax machine or the like which uses electronic photography is provided with a fixing apparatus. The fixing apparatus is provided for heating a recording medium such as paper or the like which carries a toner image formed from toner in an unfixed state as well as for applying pressure thereto to fix the toner image onto the recording medium (see JP-A No. 2004-262976).

Such a fixing unit includes a pair of cylindrical rollers (rotating bodies) which are rotated with being pressed to each other, and a heat source which heats at least one of these rollers. By passing the recording medium through the nip formed by the pair of rollers which are pressed to ea ch other, and applying heat and pressure to the recording medium, the toner image formed on the recording medium is fixed onto the recording medium.

Recently, according to the increased printing speed, the heater tends to consume a greater amount of electricity for the sake of, e.g., shortening a warm-up time. The heater with increased electricity consumption has a small resistance, which involves a problem in that a surge current may flow therethrough to thereby generate what is called a "flicker" phenomenon at the time when the connection to an electric power source is switched from an off-state to an on-state. Particularly, this problem becomes conspicuous at the time when the heater remains at a lower temperature, because the resistance of the heater is also kept small at this time.

In order to solve this problem, there is known a method of increasing the resistance value of a heater-containing circuit by connecting a heater and a resistor to a power source in series when the connection of the heater (first heater) with high electricity consumption to the power source is switched from an off-state to an on-state.

A heater (second heater) is used as the resistor in the Japanese publication cited above. This makes it possible to avoid any occurrence of flicker and, in addition, to efficiently employ the heat energy generated by the heater in heating the afore-mentioned rotating bodies or other components.

However, even with the combination of resistance values of the first heater and the second heater described above, there has still existed such an instance that the heating value of the first heater becomes too small when the first heater and the second heater are energized in series, thus making it impossible to avoid the occurrence of flicker.

SUMMARY OF THE INVENTION

It is an object of the present invention to provide a fixing unit and an image forming apparatus equipped with the fixing unit that can avoid any occurrence of flicker and exhibit an excellent fixing ability.

In order to achieve the object mentioned just above, the present invention is directed to a fixing unit for use in passing a recording medium carrying a unfixed image through between a pair of rotating bodies which are rotated with being pressed to each other to heat and press the recording medium thereby filing the unfixed image to the recording medium, comprising: a first heater for generating heat energy with electric current supplied from a power source to heat up one of the rotating bodies; a second heater for generating heat energy with the electric current supplied from the power source to heat up the one of the rotating bodies or other components; and a switching means for changing over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes a heating value of the first heater in the first state per unit of time and $Q_{21}$ denotes a heating value of the first heater in the second state per unit of time.

This makes it possible to optimize the resistance values of the first heater and the second heater, thus assuring that, in the first state, the first heater and the second heater can generate heat energy in a preferred manner while reducing the resistance value of a circuit connected to the power source. As a result, the fixing unit can avoid any occurrence of flicker and exhibit an excellent fixing ability.

According to the fixing unit of the present invention, it is preferred that the switching means is adapted to change over the first state and the second state based on a history of electric current supply to the first heater.

This prevents the switching means from inadvertently taking the first state, as a result of which one of the rotating bodies can be efficiently heated by the first heater.

According to the fixing unit of the present invention, it is preferred that the switching means is adapted to take the first state in the case where no electric current was supplied to the first heater within a predetermined time period in advance of restarting the electric current supply, but take the second state in the case where the electric current was supplied to the first heater within the predetermined time period.

This allows the switching means to perform a change-over operation with a relatively simple construction.

According to the fixing unit of the present invention, it is preferred that the second heater is adapted to heat up the other of the rotating bodies.

This makes sure that the recording medium can be heated at its opposite sides in the course of subjecting the recording medium with a unfixed image to a fixing treatment, thereby making it possible to effectively use the heat energy generated by the second heater, greatly improve the fixing ability of the fixing unit and prohibit the recording medium from taking a curled shape at the end of fixing process.

According to the fixing unit of the present invention, it is preferred that the fixing unit further comprises a first temperature detector means for detecting a temperature of one of the rotating bodies, a second temperature detector means for detecting a temperature of the other components and a control means for controlling an amount of the electric current supplied from the power source to the first heater and the second heater per unit of time in response to the temperature detected by the first temperature detector means and the second temperature detector means, wherein the second heater is adapted to heat up the other of the rotating bodies and wherein the control means is adapted, in the first state, to control the amount of the electric current supplied from the power source to the first heater and the second heater per unit of time in response to the temperature detected by the second temperature detector means and, in the second state, to control the amount of the electric current supplied from the power source to the first heater per unit of time in response to the temperature detected by the first temperature detector means.

This makes it possible to raise the temperature of one of the rotating bodies or other components heated by the second heater to a desired temperature through a simple control process and in a quite precise manner.

According to the fixing unit of the present invention, it is preferred that the relation: $Q_{11}<Q_{12}$ is satisfied, where $Q_{12}$ denotes a heating value of the second heater in the first state per unit of time.

This makes it possible, in the first state, to speedily raise the temperature of the one of the rotating bodies or the other components heated by the second heater.

According to the fixing unit of the present invention, it is preferred that the relations: $Q_{21}>Q_{T1}>Q_{11}$, $Q_{12}>Q_{T2}$ and $Q_{21}\times(1-Q_{T2}/Q_{12})+Q_{11}\times Q_{T2}/Q_{12}>Q_{T1}$ are satisfied, where $Q_{12}$ denotes a heating value of the second heater in the first state per unit of time, $Q_{T1}$ denotes a heating value required to maintain the one of the rotating bodies heated by the first heater at a first target temperature per unit of time, and $Q_{T2}$ denotes a heating value required to maintain the other of the rotating bodies or the other components heated by the second heater at a second target temperature lower than the first target temperature per unit of time.

This makes it possible to raise the temperature of the one of the rotating bodies heated by the first heater and the temperature of the other of the rotating bodies or the other components heated by the second heater to a desired temperature through a simple control and in a quite precise manner.

According to the fixing unit of the present invention, it is preferred that the switching means is adapted to primarily take the second state when the one of the rotating bodies is heated up to the first target temperature, but mainly take the first state when the other components are heated up to the second target temperature lower than the first target temperature.

This helps shorten the warm-up time.

According to the fixing unit of the present invention, it is preferred that the switching means comprises a first switch element for connecting the first heater and the second heater to the power source in series and a second switch element for short-circuiting the second heater and at the same time connecting the first heater to the power source, wherein the first state is taken by turning on the first switch element and the second state is taken by turning on the second switch element.

This makes it possible to positively avoid any occurrence of flicker and conduct the change-over operation between the first state and the second state with a relatively simple construction.

According to the present invention, there is provided an image forming apparatus which incorporates the fixing unit described above.

This ensures that the image forming apparatus can avoid any occurrence of flicker and exhibit an excellent fixing ability.

The above and other objects and features of the invention will become more apparent from the following detailed description when the same is read in conjunction with the accompanying drawings that are presented for the purpose of illustration only.

DETAILED DESCRIPTION OF THE PREFERRED EMBODIMENTS

Hereinbelow, preferred embodiments of a fixing unit and an image forming apparatus equipped with the fixing unit in accordance with the present invention will be described with reference to FIGS. 1 through 7.

Figure 1:
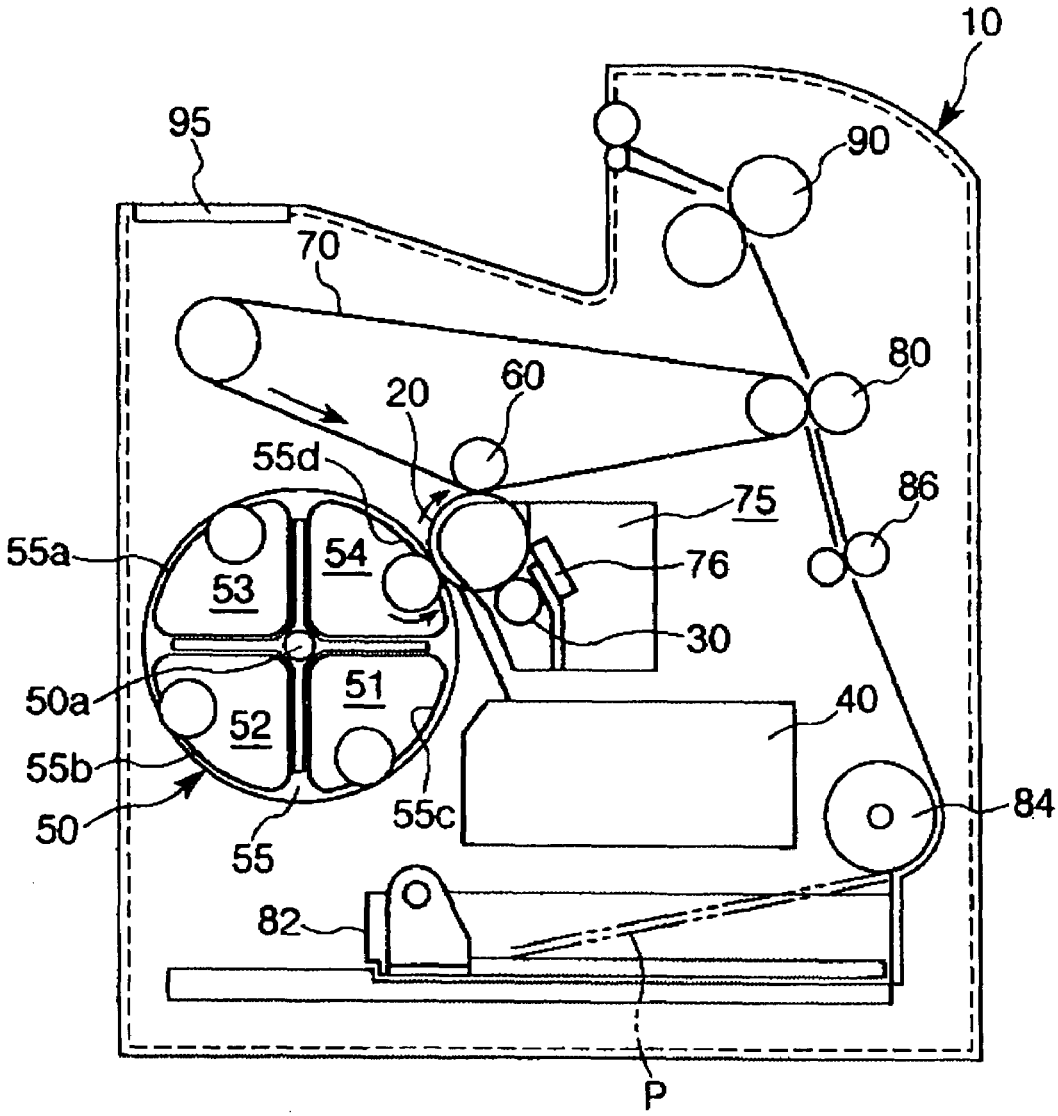
FIG. 1 is a schematic cross-sectional view of the overall construction which shows one embodiment of an image forming apparatus in accordance with the present invention.
Figure 2:
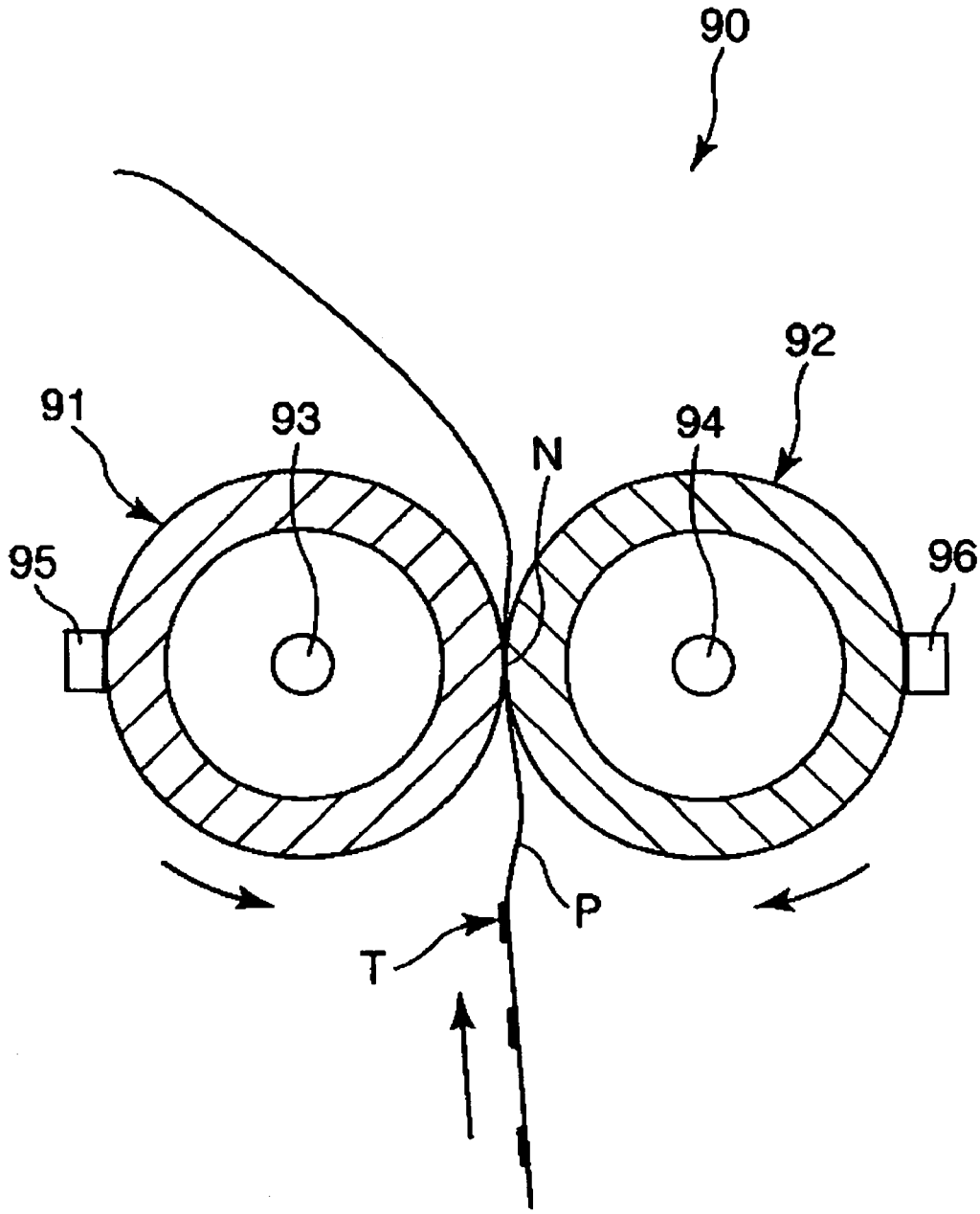
FIG. 2 is a schematic cross-sectional view which illustrates a preferred embodiment of a fixing unit employed in the image forming apparatus shown in FIG. 1.
Figure 3:
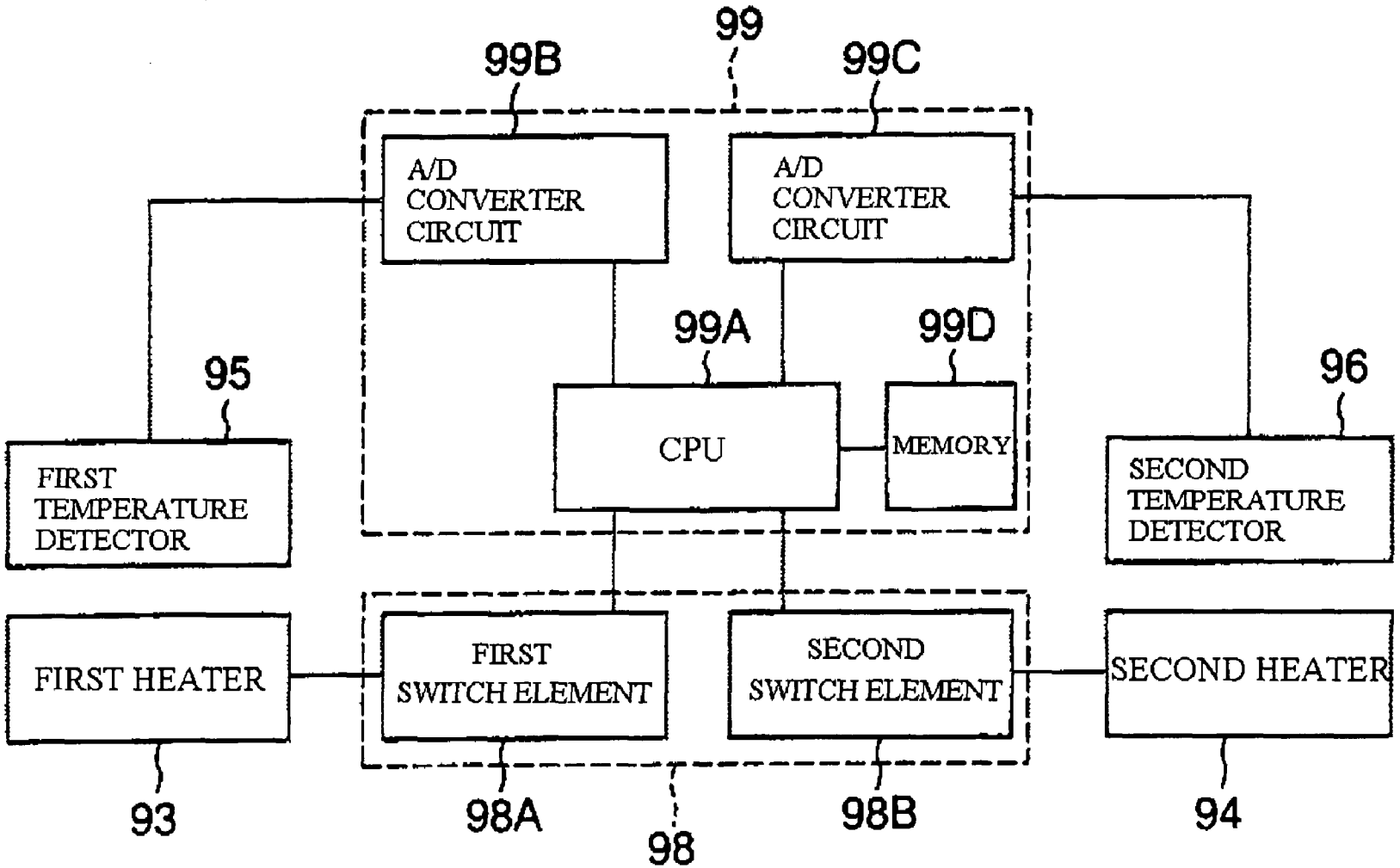
FIG. 3 is a block diagram which shows a heater control system of the fixing unit illustrated in FIG. 2.
Figure 4:
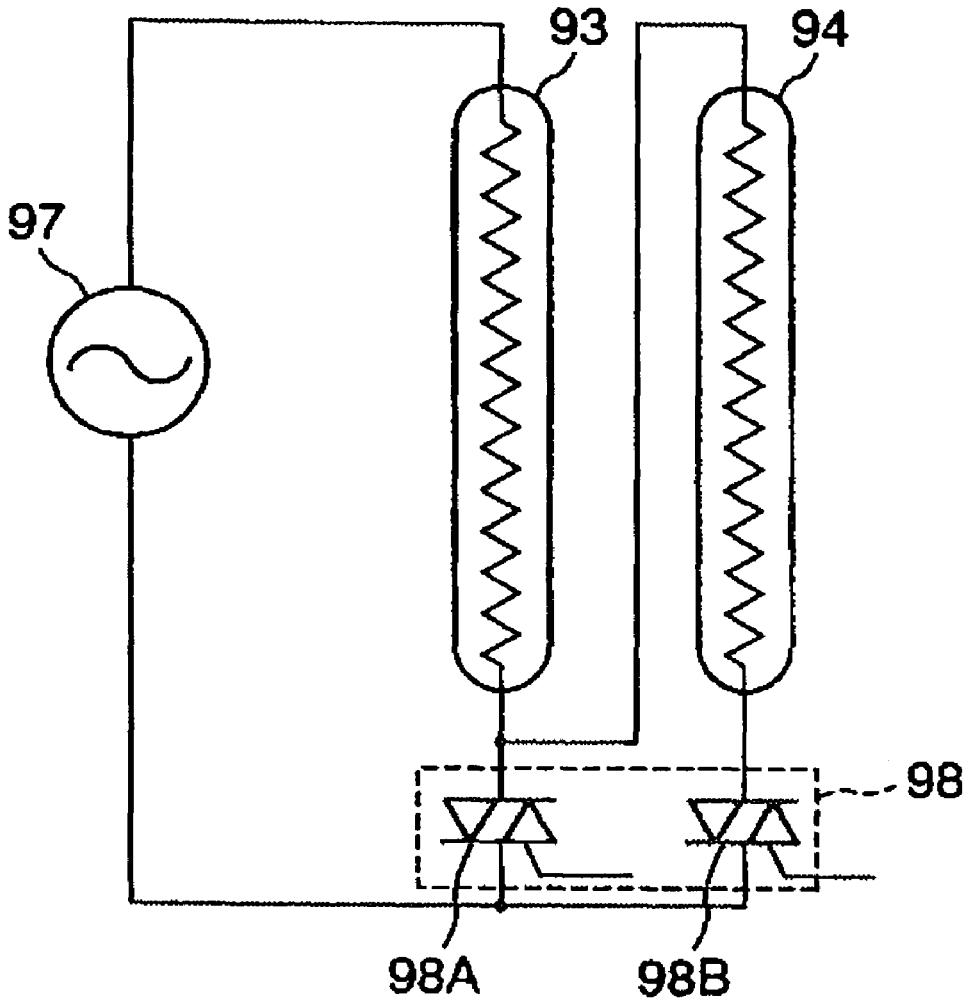
FIG. 4 is a schematic view which illustrates a heater drive circuit of the fixing unit illustrated in FIG. 2.
Figure 5:
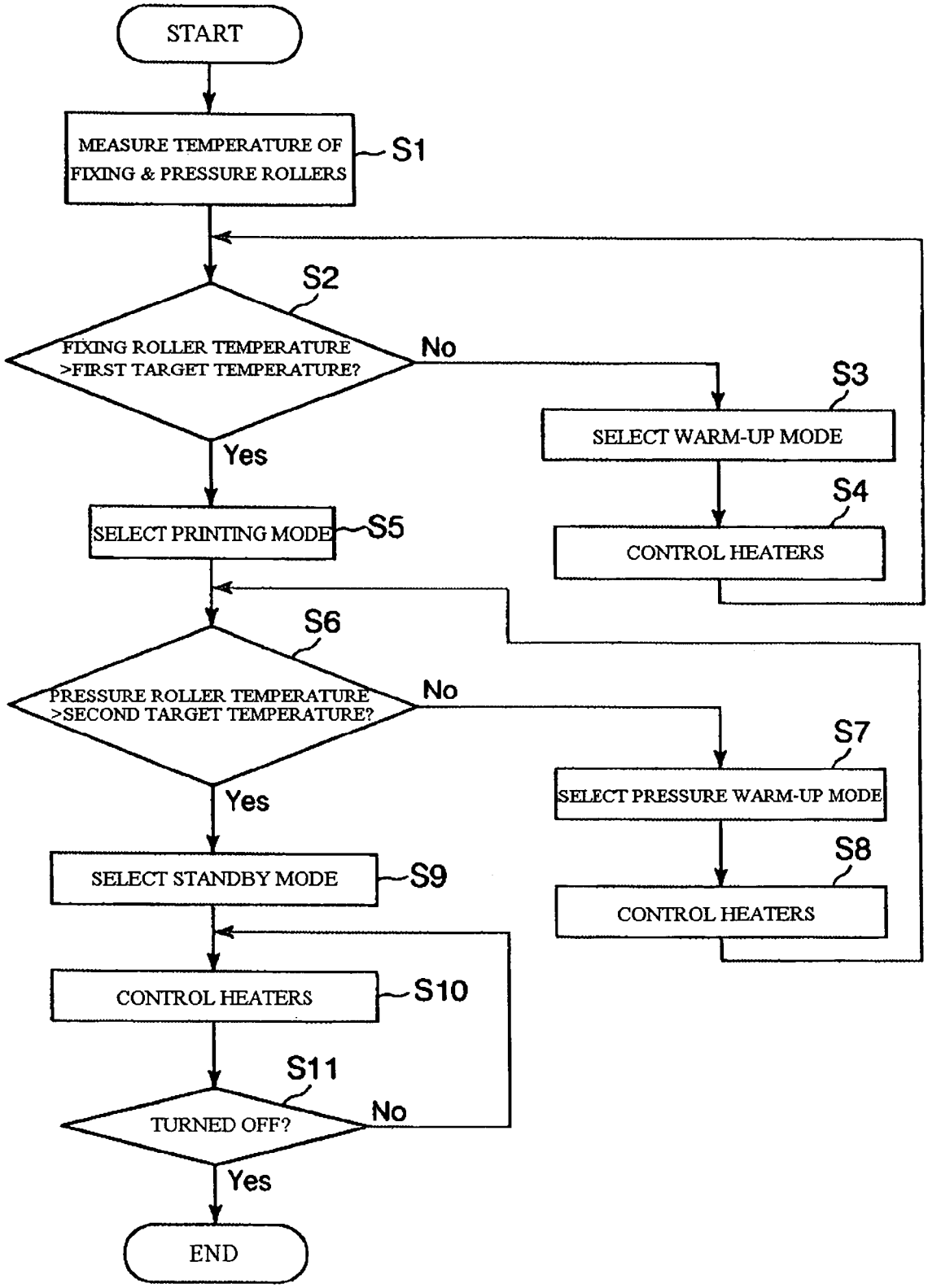
FIG. 5 is a flowchart for explaining a heater drive control operation in the fixing unit illustrated in FIG. 2.
Figure 6:
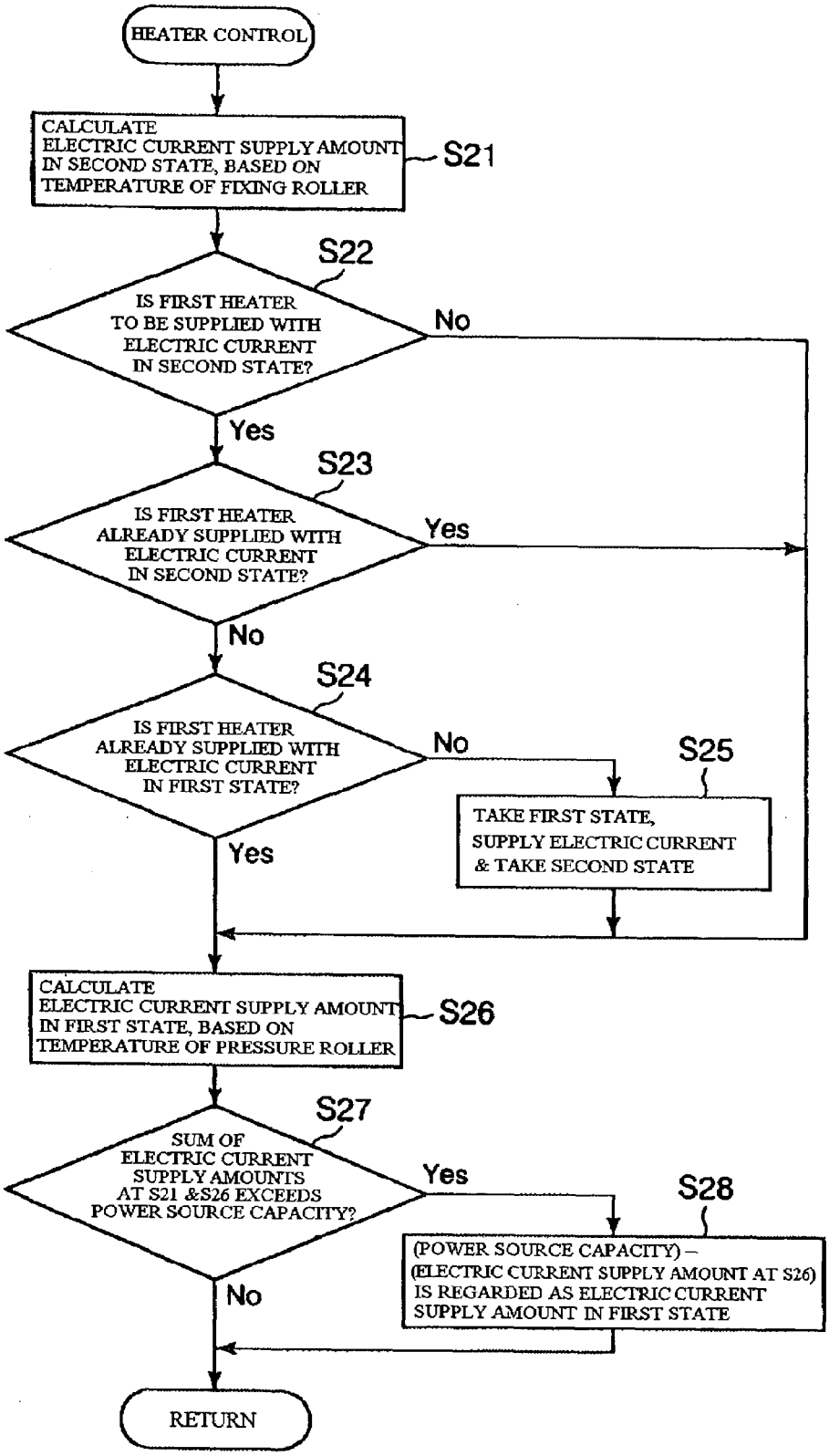
FIG. 6 is a flowchart for explaining a heat drive control operation in the fixing unit illustrated in FIG. 2.
Figure 7:
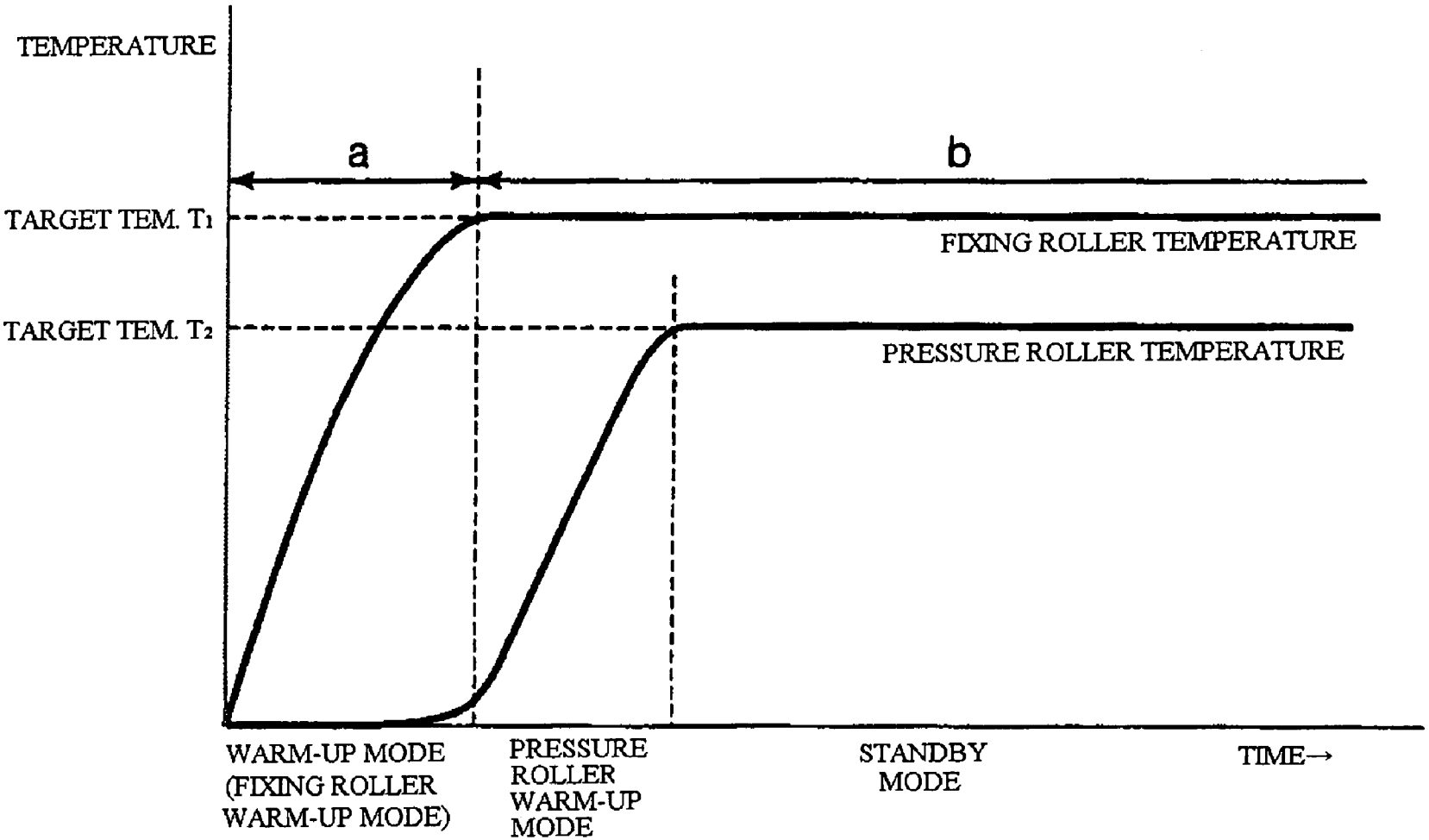
FIG. 7 is a view which shows the temperature transition of a fixing roller and a pressure roller in the fixing unit illustrated in FIG. 2.

FIG. 1 is a schematic cross-sectional view of the overall construction which shows one embodiment of an image forming apparatus in accordance with the present invention; FIG. 2 is a schematic cross-sectional view which illustrates a preferred embodiment of a fixing unit employed in the image forming apparatus shown in FIG. 1; FIG. 3 is a block diagram which shows a heater control system of the fixing unit illustrated in FIG. 2; FIG. 4 is a schematic view which illustrates a heater drive circuit of the fixing unit illustrated in FIG. 2; FIG. 5 is a flowchart for explaining a heater drive control operation in the fixing unit illustrated in FIG. 2; FIG. 6 is a flowchart for explaining a heat drive control operation in the fixing unit illustrated in FIG. 2; and FIG. 7 is a view which shows the temperature transition of a fixing roller and a pressure roller in the fixing unit illustrated in FIG. 2.

Image Forming Apparatus

In advance of describing a fixing unit of the present invention, brief explanation is offered regarding an image forming apparatus that incorporates the fixing unit.

As shown in FIG. 1, the image forming apparatus 10 of this embodiment is provided with a photosensitive body 20 that carries latent images and rotates in the direction of arrow. The image forming apparatus 10 further includes a charging unit 30, an exposure unit 40, a developing unit 50, a primary transfer unit 60 and a cleaning unit 75 in the named sequence, and they are arranged in that order along the rotational direction of the photosensitive body 20. In addition, the image forming apparatus 10 is provided, at the lower part in FIG. 1, with a paper supply tray 82 that serves to feed a recording medium P such as a paper. A secondary transfer unit 80 and a fixing unit 90 are sequentially disposed with respect to the paper supply tray 82 at the downstream of the conveying direction of the recording medium P.

The photosensitive body 20 has a cylindrical conductive base material (not shown in the drawings) and a photosensitive layer (not shown) formed on the circumference thereof. The photosensitive body 20 is rotatable about its axis in the direction indicated with the arrow in FIG. 1.

The charging unit 30 is a device for uniformly charging the surface of the photosensitive body 20 by means of corona charging and the like.

The exposure unit 40 is a device which forms an electrostatic latent image by receiving image information from a host computer such as a personal computer not shown in the drawings, and in response to the image information received, irradiating a laser beam onto the uniformly charged photosensitive body 20.

The developing unit 50 includes four developing devices, i.e., a black developing device 51, a magenta developing device 52, a cyan developing device 53 and a yellow developing device 54. These developing devices 51, 52, 53, 54 are devices which make the latent image visible as a toner image and selectively used in correspondence to the latent image formed on the photosensitive body 20. The black developing device 51 uses black(K) toner, the magenta developing device 52 uses magenta(M) toner, the cyan developing device 53 uses cyan(C) toner, and the yellow developing device 54 yellow(Y) toner.

In the present embodiment, the YMCK developing unit 50 is rotatable in such a manner that it can cause the four developing devices 51, 52, 53, 54 to selectively face the photosensitive body 20. More specifically, the four developing devices 51, 52, 53, 54 of the YMCK developing unit 50 are respectively supported on four holder portions 55*a*, 55*b*, 55*c*, 55*d* of a holder member that can be rotated about a shaft 50*a*. By rotating the holder member 55, the four developing devices 51, 52, 53, 54 are selectively made to face the photosensitive body 20 while maintaining the relative positional relationship therebetween.

The primary transfer unit 60 is a device for transferring a monochrome toner image created on the photosensitive body 20 to an intermediate transfer member 70.

The intermediate transfer member 70 is an endless belt that can be driven rotationally at roughly the same circumferential speed as the photosensitive body 20 in the direction of the arrow shown in FIG. 1. A toner image having at least one color selected from black, magenta, cyan and yellow is carried on the intermediate transfer member 70. For example, when forming a full color image, transferring is carried out by sequentially layering toner images having the four colors including black, magenta, cyan and yellow to form a full color toner image.

The secondary transfer unit 80 is a device that serves to transfer monochrome or full color images or the like formed on the intermediate transfer member 70 to a recording medium P such as a paper, film and cloth or the like.

The fixing unit 90 is an apparatus for fixing the toner image to the recording medium P as a permanent image by applying heat and pressure to the recording medium P on which the toner image has been transferred. In this regard, the fixing unit 90 will be described in detail later.

The cleaning unit 75 is a device that comprises a rubber cleaning blade 76 which makes contact with the surface of the photosensitive body 20 between the primary transfer unit 60 and the charging unit 30. The cleaning unit 75 is provided for scrapping off any toner that remains on the photosensitive body 20 by the cleaning blade 76 after the toner image has been transferred to the intermediate transfer member 70 by means of the primary transfer unit 60.

Next, the operation of the image forming apparatus 10 having the afore-mentioned structure will be described.

First, in response to the command from a host computer not shown in the drawings, the photosensitive body 20, developing rollers (not shown) provided on the developing unit 50, and the intermediate transfer member 70 are started to rotate. The photosensitive body 20 is sequentially charged by means of the charging unit 30 while rotating.

The charged area of the photosensitive body 20 reaches the exposure position according to the rotation of the photosensitive body 20, and at that position a latent image according to first color (e.g. yellow) image information is formed in such area by the exposure unit 40.

The latent image formed on the photosensitive body 20 reaches the developing position according to the rotation of the photosensitive body 20, and developing with yellow toner is carried out by the yellow developing device 54. In this way, a yellow toner image is formed on the photosensitive body 20. At this time, the yellow developing device 54 of the YMCK developing unit 50 faces the photosensitive body 20 at such developing position.

The yellow toner image formed on the photosensitive body 20 reaches the primary transfer position according to the rotation of the photosensitive body 20, and is transferred to the intermediate transfer member 70 by the primary transfer unit 60. At this time, a primary transfer voltage (primary transfer bias) having the opposite polarity as the charge polarity of the toner is applied in the primary transfer unit 60. Furthermore, during this time, the secondary transfer unit 80 is separated from the intermediate transfer member 70.

The same treatment as set forth just above is repeatedly carried out for the second, third and fourth colors so that the toner images for each of the colors corresponding to the respective image signal can be transferred to the intermediate transfer member 70 one above another. In this way, a full color image is formed on the intermediate transfer member 70.

In the meantime, the recording medium P is conveyed from the paper supply tray 82 to the secondary transfer unit 80 by means of a paper supply roller 84 and register rollers 86.

The full color toner image formed on the intermediate transfer member 70 reaches the secondary transfer position according to the rotation of the intermediate transfer member 70, and is transferred to the recording medium P by means of the secondary transfer unit 80. At this time, the secondary transfer unit 80 applies pressure and a secondary transfer voltage (secondary transfer bias) to the intermediate transfer member 70.

The full color toner image thus transferred to the recording medium P is fused to the recording medium P by applying heat and pressure by the fixing unit 90.

On the other hand, after the photosensitive body 20 has passed the primary transfer position, any toner adhering to the surface of the photosensitive body 20 is scraped off by the cleaning blade 76 of the cleaning unit 75 in preparation for the subsequent charge process for forming the next latent image. The toner scraped off in this manner is collected in a residue toner collecting portion inside the cleaning unit 75.

Fixing Unit

Now, the fixing unit 90 will be described in detail with reference to FIGS. 2 to 7.

As illustrated in FIG. 2, the fixing unit 90 is provided with a pair of rotating bodies which are rotated with being pressed to each other, i.e., a fixing roller 91 and a pressure roller 92, a first heater 93 for heating the fixing roller 91, a second heater 94 for heating the pressure roller 92, a first temperature detector 95 (temperature detector means) for detecting a temperature of the fixing roller 91, and a second temperature detector 96 (another temperature detector means) for detecting a temperature of the pressure roller 92.

The fixing roller 91 has a hollow cylindrical configuration and can rotate about an axis thereof. Further, within the internal space of the fixing roller 91, there is disposed the first heater 93 that serves to heat up the fixing roller 91.

The pressure roller 92 is in a shape of hollow or solid cylinder and can rotate about an axis thereof with being pressed against the fixing roller 91. Within the internal space of the pressure roller 92, there is provided the second heater 94 that serves to heat up the pressure roller 92.

With this fixing unit 90, the recording medium carrying a unfixed image is conveyed from the bottom in FIG. 2 toward a nip N formed between the fixing roller 91 and the pressure roller 92 pressed against the fixing roller 91, at which nip the recording medium is heated and pressed such that the unfixed image can be fixed to the recording medium. In the present embodiment, the recording medium conveyed toward the nip N carries the unfixed image on the side facing the fixing roller 91.

The first temperature detector 95 for detecting the temperature of the fixing roller 91 may be a thermistor, for example, and is disposed in contact with or adjacent to the circumferential surface of the fixing roller 91. In response to the temperature detected by the first temperature detector 95, operation of the afore-mentioned first heater 93 is controlled by a control means 99 described below in such a manner that the outer surface of the fixing roller 91 can reach a first target temperature.

In addition, the second temperature detector 96 for detecting the temperature of the pressure roller 92 may be a thermistor, for example, and is disposed in contact with or adjacent to the circumferential surface of the pressure roller 92. In response to the temperature detected by the second temperature detector 96, operation of the afore-mentioned second heater 94 is controlled by the control means 99 described below in such a manner that the outer surface of the pressure roller 92 can reach a second target temperature.

According to the present embodiment, the recording medium can be heated at its opposite sides by the fixing roller and the pressure roller in the course of subjecting the recording medium carrying a unfixed image to the fixing treatment, thereby making it possible to effectively use the heat energy generated by the second heater 94, greatly improve the fixing ability of the fixing unit and prevent the recording medium from taking a curled shape at the end of the fixing process.

Hereinbelow, operations of the first heater 93 and the second heater 94 of the fixing unit 90 will be described in detail.

Referring to FIG. 3, the fixing unit 90 is provided with a switching means 98 for changing over or switching the electric current supply status to the first heater 93 and the second heater 94 and a control means 99 for controlling the change-over operation of the switching means 98 based on the detection result of the first temperature detector 95 and the second temperature detector 96.

The switching means 98 has a first switch element 98A that can switch the electric current supply status of the first heater 93 between a conduction state and a cut-off state and a second switch element 98B that can switch the electric current supply status of the second heater 94 between a conduction state and a cut-off state.

As shown in FIG. 4, the first switch element 98A is adapted, at the conduction state, to short-circuit the second heater 94 to thereby substantially cut off the electric current supply to the second heater 94, while connecting the first heater 93 to an alternating current power source 97 so that the electric current can be supplied to the first heater 93 from the power source 97.

Referring again to FIG. 4, the second switch element 98B is adapted, at the conduction state, to serially connect the first heater 93 and the second heater 94 to the alternating current power source 97 so that the electric current can be supplied to the first heater 93 and the second heater 94 from the power source 97.

Turning back to FIG. 3, the control means 99 for controlling the change-over operation (switching operation) of the switching means 98 is adapted to convert analog output signals of the first temperature detector 95 to digital ones in an A/D converter circuit 99B and also convert analog output signals of the second temperature detector 96 to digital ones in an A/D converter circuit 99C, after which a Central Processing Unit (CPU) 99A controls the operation of the first switch element 98A and the second switch element 98B in response to the converted digital signals.

The control means 99 of this embodiment controls the amount of electric current supply to the first heater 93 and the second heater 94 by way of repeatedly changing over the first switch element 98A and the second switch element 98B from an on-state to an off-state and vice versa for a predetermined time period during which several to several tens of voltage waves appear from the alternating current power source 97.

More specifically, in a second state, the control means 99 controls the amount of electric current supply to the first heater 93 by changing the ratio of cumulative on-state time of the first switch element 98A during the predetermined time period, which ratio is referred to as "main duty" hereinbelow. In a first state, the control means 99 controls the amount of electric current supply to the first heater 93 and the second heater 94 by changing the ratio of cumulative on-state time of the second switch element 98B during the predetermined time period, which ratio is referred to as "serial duty" hereinbelow.

Furthermore, the control means 99 is provided with a memory 99D for storing the change-over pattern information of the switching means 98 for a given period of time. Based on the change-over pattern information stored in the memory 99D, the control means 99 is adapted to determine whether the electric current was supplied to the first heater 93 within a predetermined time period in advance of restarting the electric current supply. Further, the control means 99 controls the switching means 98 to take the first state if it is determined that no electric current was supplied but to take the first state or the second state if it is determined that electric current supply has been carried out.

The first heater 93 and the second heater 94 are designed to satisfy the relation: $Q_{11}/Q_{21}>1/8$, where $Q_{11}$ denotes a heating value [W] of the first heater 93 in the first state per unit of time and $Q_{21}$ denotes a heating value [W] of the first heater 93 in the second state per unit of time. This makes it possible to optimize the resistance values of the first heater 93 and the second heater 94, thus assuring that, in the first state, the first heater 93 and the second heater 94 can generate heat energy in a preferred manner while reducing the resistance value of a circuit connected to the power source. As a result, the fixing unit can avoid any occurrence of flicker and exhibit an excellent fixing ability.

Moreover, the first heater 93 and the second heater 94 satisfy the relation: $Q_{11}<Q_{12}$, where $Q_{12}$ denotes a heating value [W] of the second heater in the first state per unit of time. This makes it possible, in the first state, to speedily raise the temperature of the pressure roller 92 heated by the second heater.

In addition, the first heater 93 and the second heater 94 satisfy the following relations:

$$Q_{21}>Q_{T1}>Q_{11},$$

$$Q_{12}>Q_{T2} \text{ and}$$

$$Q_{21}\times(1-Q_{T2}/Q_{12})+Q_{11}\times Q_{T2}/Q_{12}>Q_{T1},$$

where $Q_{12}$ denotes a heating value [W] of the second heater in the first state per unit of time, $Q_{T1}$ denotes a heating value [W] required to maintain the fixing roller 91 heated by the first heater at a first target temperature per unit of time, and $Q_{T2}$ denotes a heating value [W] required to maintain the pressure roller 92 heated by the second heater at a second target temperature lower than the first target temperature per unit of time. This makes it possible to raise the temperature of the fixing roller 91 heated by the first heater and the temperature of the pressure roller 92 heated by the second heater to a desired temperature through a simple control and in a quite precise manner.

Here, a method of controlling the operation of the first heater 93 and the second heater 94 will now be described specifically with reference to FIG. 5.

At first, when the image forming apparatus 10 is turned on, measurements of the temperatures of the fixing roller 91 and the pressure roller 92 are started (Step S1).

At the next step, determination is made as to whether the temperature of the fixing roller 91 is equal to or greater than the first target temperature, namely whether the temperature of the fixing roller 91 is on or above a temperature that allows printing operation (Step S2).

In the case where the temperature of the fixing roller 91 fails to reach the first target temperature, the first switch element 98A of the switching means 98 is caused to become the on-state, i.e., the second state, to thereby select a warm-up mode wherein the task of raising the temperature of the fixing roller 91 is carried out firstly (Step S3). Then, the first heater 93 is driven with the electric current supply amount corresponding to the temperature of the fixing roller 91 (Step S4). The afore-mentioned steps (S2 through S4) are repeated until the temperature of the fixing roller 91 reaches the first target temperature, during which time the image forming apparatus 10 lies in a non-printable condition.

On the other hand, when the temperature of the fixing roller 91 has reached the first target temperature, the image forming apparatus 10 is converted to a printable condition, thus selecting a printing mode (Step S5), and determination is made as to whether the temperature of the pressure roller 92 is equal to or greater than the second target temperature (Step S6).

In the case where the temperature of the pressure roller 92 fails to reach the second target temperature, the second switch element 98B of the switching means 98 is caused to become the on-state, i.e., the second state, while keeping the first switch element 98A of the switching means 98 in the on-state, to thereby select a pressure warm-up mode wherein the task of raising the temperature of the pressure roller 92 is performed firstly (Step S7). Then, the second heater 94 is driven with the electric current supply amount corresponding to the temperature of the pressure roller 92 (Step S8). The afore-mentioned steps (S6 through S8) are repeated until the temperature of the pressure roller 92 reaches the second target temperature.

On the other hand, in the case where the temperature of the pressure roller 92 has reached the second target temperature, a standby mode is selected to maintain the fixing roller 91 and the pressure roller 92 at a printable temperature by alternately repeating the second state wherein the first switch element 98A of the switching means 98 is in the on-state, and the first state wherein the second switch element 98B of the switching means 98 is in the on-state with the first switch element 98A remaining in the on-state (Step S9). The first heater 93 and the second heater 94 are driven with the electric current supply amount corresponding to the temperature of the fixing roller 91 and the pressure roller 92 (Step S10). Step 10 mentioned just above is repeated until and unless the image forming apparatus 10 is turned off (Step S11).

As the first heater 93 and the second heater 94 are driven in this fashion, the fixing roller 91 and the pressure roller 92 show a temperature transition as graphically illustrated in FIG. 7. In FIG. 7, the second state chiefly occupies the section "a", while the first state and the second state are alternately changed over in the section "b".

Operation of the first heater 93 and the second heater 94 will be specifically described in the following with respect to the heater control at step S4 described above.

Referring to FIG. 6, in order to raise the temperature of the fixing roller 91 as quickly as possible with no overheating, the electric current supply amount (main duty) to be supplied to the first heater 93 in the second state is calculated based on the temperature of the fixing roller 91 (Step S21). More specifically, in response to the difference between the temperature of the fixing roller 91 and the first target temperature, the ratio of cumulative on-state time (main duty) of the first switch element 98A is decided for a predetermined time period during which several to several tens of voltage waves appear from the alternating current power source 97.

Then, in the next step, determination is made as to whether or not there is a need to supply electric current to the first heater 93 in the second state, specifically as to whether or not the decided main duty is amount to 0% (Step S22).

In the case where the decided main duty is equal to 0%, i.e., in the case where there is no need to supply electric current to the first heater in the second state, the flow proceeds to S26 described below because it is not necessary to change over the switching means 98 from the first state to the second state. On the other hand, in the case where the decided main duty is not 0%, i.e., in the case where a need exists to supply electric current to the first heater 93 in the second state, determination should be made as to whether a sufficient amount of electric current has already been supplied to the first heater 93 in the first state (Step S23). In more concrete terms, on the basis of the information stored in the memory 99D, it is judged whether the main duty at the preceding time (at the predetermined time period ahead of the current one) is equal to 100%.

In the case where the judgment indicates that the main duty at the preceding time is 100%, the flow proceeds to S26 described below because the first heater 93 is already kept at an elevated temperature and therefore there is no need to change over the switching means 98 from the first state to the second state. On the other hand, in the case where the main duty at the preceding time is not 100%, determination is made as to whether the first heater 93 has been already supplied with the electric current in the first state (Step S24). To be more specific, on the basis of the information stored in the memory 99D, it is judged whether the serial duty at the preceding time (at the predetermined time period ahead of the current one) is equal to 0%.

In the case where the serial duty at the preceding time is 0%, i.e., in the case where the first heater 93 is not supplied with the electric current in the first state, the electric current supply status is changed over to the first state and then the first heater 93 and the second heater 94 are supplied with the electric current for, e.g., 400 ms. Thereafter, the flow proceeds to S26 described later (Step S25). In this manner, the control means 99 causes the switching means 98 to be changed over between the first state and the second state, based on the history of electric current supply to the first heater 93. This makes it possible to change over the switching means 98 with a relatively simple construction.

On the other hand, in the case where the serial duty at the preceding time is not 0%, i.e., in the case where the first heater 93 has been already supplied with the electric current in the first state, the amount of electric current supply (that is, serial duty) to the first heater 93 and the second heater 94 in the first state is calculated based on the temperature of the pressure roller 92 (Step S26).

Subsequently, judgment is made as to whether or not the sum of the serial duty thus calculated and the main duty obtained at S21 exceeds the capacity of the power source (Step S27).

In the case where the sum of the duties is in excess of 100%, namely in the case where the serial duty calculated in FIG. 6 is greater than (100%-main duty), the solution of 100%-main duty is regarded as the serial duty (Step S28). On the other hand, in the case where the sum of the duties is equal to or less than 100%, namely if the serial duty is no greater than (100%-main duty), the serial duty calculated at S26 is regarded as the serial duty.

Moreover, the heater control at S8 in FIG. 5 can be performed in accordance with the flowchart shown in FIG. 6. Specifically, in view of the fact that the temperature of the fixing roller 91 reaches the first target temperature at S8, the main duty is calculated at S21 and then the flow proceeds to S26 from S22-S24 without going through S25 to calculate the serial duty.

Likewise, the heater control at S10 in FIG. 5 can be performed in accordance with the flowchart shown in FIG. 6. Specifically, in light of the fact that the temperature of the pressure roller 92 reaches the second target temperature at S10, the main duty is calculated at S21 and then the flow proceeds to S26 from S22-S24 without going through S25 to calculate the serial duty.

Although the image forming apparatus of the present invention has been described in the foregoing in conjunction with a preferred embodiment, it should be appreciated that the present invention is not limited to this embodiment but instead may be modified in many different ways.

Components that can be heated by the second heater 94 is not limited to the pressure roller 92 and may include other kinds of components as far as they are suitable for effectively using the heat energy generated by the second heater 94.

For example, a guide member for guiding the recording medium toward the nip N ahead of fixing process may be heated by the second heater 94, in which case the recording medium carrying a unfixed image is preheated before passing through the nip N. This allows an excellent fixing ability to be performed and helps avoid any creation of wrinkles on the recording medium at the end of the fixing process.

In addition, those components disposed around the moving region of the recording medium at the downstream of the nip N may also be heated by the second heater 94. In this case, it becomes possible to prevent the moisture produced by dew condensation in the fixing unit 90 from adhering to the image-fixed recording medium, thus greatly improving the quality of the fixed image obtained.

Furthermore, the fixing roller 91 may be heated by the second heater 94. In other words, it may be contemplated that both the first heater 93 and the second heater 94 are used to heat the fixing roller 91. This makes sure that the temperature of the fixing roller 91 can be raised in a faster manner, thereby shortening the warm-up time, i.e., the time required from turning-on of the image forming apparatus and start of the fixing operation.

If the fixing roller 91 is heated by both the first heater 93 and the second heater 94 in this fashion, it becomes possible to make the temperature distributions of the first heater 93 and the second heater 94 in an axial direction of the fixing roller 91 differ from each other. By virtue of this, the temperature of the fixing roller 91 can be raised in a faster manner to thereby shorten the warm-up time, and the axial temperature distribution of the fixing roller 91 can be changed to a desired one with ease.

EXAMPLE 1

By using the circuit construction shown in FIG. 3, a fixing unit as illustrated in FIGS. 2 and 4 was produced wherein a first heater has a heating value of 200 W in a first state per unit of time and a heating value of 800 W in a second state per unit of time.

EXAMPLES 2-6

Fixing units were produced in the same manner as in Example 1, except that the heating values of a first heater in a first state and a second state per unit of time are established as in Table 1.

COMPARATIVE EXAMPLES 1-3

Fixing units were produced in the same manner as in Example 1, except that the heating values of a first heater in a first state and a second state per unit of time are established as in Table 1.

With respect to Examples 1-6 and Comparative Examples 1-3 described above, the effect of reducing flicker provided by each of the fixing units were evaluated and shown in Table 1.

Evaluation of the flicker reduction effect was conducted by the naked eyes of a user. In Table 1, symbol "O" indicates that flicker reduction is felt by the user whereas symbol "X" means that no flicker reduction is felt by the user. Also shown in Table 1 are the value of $Q_{11}/Q_{21}$ and the equation: (surge current in case of a second state being taken via a first state after turning on an apparatus)/(surge current in case of a second state being taken without going through a first state after turning on an apparatus)=(serial connection)/(no serial connection).

TABLE 1

| | Heating Value of First Heater [W] | | | Reduction Ratio of Inrush Current | |
|---|---|---|---|---|---|
| | $Q_1$ in 2nd State (Activated in Single) | $Q_{11}$ in 1st State (Activated in Series) | $Q_{11}/Q_{21}$ [%] | (Serial Connection /No Serial Connection) [%] | Effect of Flicker Reduction |
| Example 1 | 800 | 200 | 25 | 60 | ○ |
| Example 2 | 800 | 120 | 15 | 70 | ○ |
| Example 3 | 800 | 100 | 12.5 | 75 | ○ |
| Example 4 | 1000 | 200 | 20 | 65 | ○ |
| Example 5 | 500 | 100 | 20 | 65 | ○ |
| Example 6 | 500 | 80 | 16 | 70 | ○ |
| Com. Ex. 1 | 800 | 50 | 6.25 | 90 | X |
| Com. | 1000 | 100 | 10 | 85 | X |

TABLE 1-continued

| | Heating Value of First Heater [W] | | | Reduction Ratio of Inrush Current | |
|---|---|---|---|---|---|
| | $Q_1$ in 2nd State (Activated in Single) | $Q_{11}$ in 1st State (Activated in Series) | $Q_{11}/Q_{21}$ [%] | (Serial Connection /No Serial Connection) [%] | Effect of Flicker Reduction |
| Ex. 2 Com. Ex. 3 | 500 | 50 | 10 | 85 | X |

Although certain preferred embodiments of the present invention have been described for illustrative purposes, it should be noted that the invention is not limited to the particular embodiments disclosed herein. It will be apparent to those skilled in the art that various changes or modifications may be made thereto within the scope of the invention defined by the appended claims.

What is claimed is:

1. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components; and a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time.

2. The fixing unit as claimed in claim 1, wherein the switch changes over the first state and the second state based on a history of electric current supply to the first heater.

3. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components; and a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time, wherein the switch changes over the first state and the second state based on a history of electric current supply to the first heater, and wherein the switch takes the first state in the case where no electric current was supplied to the first heater within a predetermined time period in advance of restarting the electric current supply, but take the second state in the case where the electric current was supplied to the first heater within the predetermined time period.

4. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components;

a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time; and a first temperature detector means for detecting a temperature of one of the rotating bodies, a second temperature detector means for detecting a temperature of the other components and a control means for controlling an amount of the electric current supplied from the power source to the first heater and the second heater per unit of time in response to the temperature detected by the first temperature detector means and the second temperature detector means, wherein the second heater is adapted to heat up the other of the rotating bodies and wherein the control means is adapted, in the first state, to control the amount of the electric current supplied from the power source to the first heater and the second heater per unit of time in response to the temperature detected by the second temperature detector means and, in the second state, to control the amount of the electric current supplied from the power source to the first heater per unit of time in response to the temperature detected by the first temperature detector means.

5. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components;

a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time, and wherein the relation: $Q_{11}<Q_{12}$ is satisfied, where $Q_{12}$ denotes a heating value of the second heater in the first state per unit of time.

6. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components;

a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time, and wherein the relations:

$$Q_{21}>Q_{T1}>Q_{11},$$

$$Q_{12}>Q_{T2} \text{ and}$$

$$Q_{21}\times(1-Q_{T2}/Q_{12})+Q_{11}\times Q_{T2}/Q_{12}>Q_{T1}$$

are satisfied, where $Q_{12}$ denotes a heating value of the second heater in the first state per unit of time, $Q_{T1}$ denotes a heating value required to maintain the one of the rotating bodies heated by the first heater at a first target temperature per unit of time, and $Q_{T2}$ denotes a heating value required to maintain the other of the rotating bodies or the other components heated by the second heater at a second target temperature lower than the first target temperature per unit of time.

7. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components;

a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time, and wherein the switch primarily takes the second state when the one of the rotating bodies is heated up to a first target temperature, but mainly takes the first state when the other components are heated up to a second target temperature lower than the first target temperature.

8. A fixing unit for use in passing a recording medium carrying an unfixed image between a pair of rotating bodies which are rotated while being pressed to each other to heat and press the recording medium thereby fixing the unfixed image to the recording medium, comprising:

a first heater which generates heat energy with electric current supplied from a power source to heat up one of the rotating bodies;

a second heater which generates heat energy with the electric current supplied from the power source to heat up the other of the rotating bodies or other components;

a switch which changes over a first state that the first heater and the second heater are serially connected to and supplied with the electric current from the power source and a second state that the first heater is connected to and supplied with the electric current from the power source while the second heater is substantially disconnected from the power source, wherein the relation: $Q_{11}/Q_{21}>1/8$ is satisfied, where $Q_{11}$ denotes energy of the first heater in the first state per unit of time and $Q_{21}$ denotes energy of the first heater in the second state per unit of time, and wherein the switch comprises a first switch element for connecting the first heater and the second heater to the power source in series and a second switch element for short-circuiting the second heater and at the same time connecting the first heater to the power source, wherein the first state is taken by turning on the first switch element and the second state is taken by turning on the second switch element.

9. An image forming apparatus incorporating the fixing unit recited in claim 1.

* * * * *